US008291542B2

(12) United States Patent
Wildeman et al.

(10) Patent No.: US 8,291,542 B2
(45) Date of Patent: Oct. 23, 2012

(54) STITCH BONDED MULTI-SURFACE FOAM CLEANING PAD

(75) Inventors: Martin Wildeman, Spartanburg, SC (US); Lori Shannon Sears, Taylors, SC (US); Michelis Hardegree, Columbus, NC (US)

(73) Assignee: Tietex International Ltd., Spartanburg, SC (US)

( * ) Notice: Subject to any disclaimer, the term of this patent is extended or adjusted under 35 U.S.C. 154(b) by 428 days.

(21) Appl. No.: 12/761,768

(22) Filed: Apr. 16, 2010

(65) Prior Publication Data

US 2010/0263154 A1 Oct. 21, 2010

Related U.S. Application Data

(60) Provisional application No. 61/170,304, filed on Apr. 17, 2009, provisional application No. 61/214,586, filed on Apr. 23, 2009.

(51) Int. Cl.
*A47L 13/16* (2006.01)

(52) U.S. Cl. ..... 15/244.3; 15/209.1; 15/228; 15/229.1; 428/88; 428/92; 428/95

(58) Field of Classification Search ..... 15/208, 15/209.1, 223, 226, 228, 229.1, 229.2, 229.6, 15/244.3; 428/88, 89, 92, 95, 102, 103, 104
See application file for complete search history.

(56) References Cited

U.S. PATENT DOCUMENTS

| | | | | |
|---|---|---|---|---|
| 3,392,078 | A | | 7/1968 | Duhl |
| 3,538,564 | A | | 11/1970 | Skoler |
| 3,975,562 | A | | 8/1976 | Madebach |
| 4,321,095 | A | | 3/1982 | Argo et al. |
| 4,891,957 | A | | 1/1990 | Strack |
| 4,931,343 | A | | 6/1990 | Becker |
| 5,377,378 | A | | 1/1995 | Cutler |
| 5,651,641 | A | * | 7/1997 | Stephens et al. ..... 405/302.6 |
| 5,804,274 | A | | 9/1998 | Nordin |
| 5,806,128 | A | | 9/1998 | Love |
| 5,814,388 | A | * | 9/1998 | Fryan ..... 428/95 |
| 5,960,508 | A | | 10/1999 | Holt et al. |
| 6,003,191 | A | | 12/1999 | Sherry et al. |
| 6,048,123 | A | | 4/2000 | Holt et al. |
| 6,101,661 | A | | 8/2000 | Policicchio et al. |

(Continued)

OTHER PUBLICATIONS

Written Opinion of the International Searching Authority in PCT/US2010/031575.

*Primary Examiner* — Mark Spisich
*Assistant Examiner* — Michael Jennings
(74) *Attorney, Agent, or Firm* — Maynard, Cooper & Gale, PC

(57) ABSTRACT

A foam core cleaning element of stitch-bonded construction having a multi-surface operative cleaning face. The cleaning element includes at least one fluid absorbing layer of absorptive polymeric foam. At least a first plurality of yarns extends in discontinuous patterned stitched relation through discrete selected zones of the fluid absorbing layer such that the first plurality of yarns forms a patterned array of first surface loop zones projecting outwardly away from a first side of the fluid absorbing layer in a defined patterned arrangement across the operative cleaning face of the cleaning element. A plurality of stitch-free zones of the polymeric foam define outwardly projecting convex curved surfaces at positions adjacent to the first surface loop zones across the operative cleaning face of the cleaning element.

19 Claims, 5 Drawing Sheets

U.S. PATENT DOCUMENTS

| | | | | |
|---|---|---|---|---|
| 6,187,411 | B1 | 2/2001 | Palmer | |
| 6,766,552 | B1 | 7/2004 | Policicchio et al. | |
| 6,855,392 | B2 * | 2/2005 | Wildeman et al. | 428/88 |
| 6,869,660 | B2 * | 3/2005 | Wildeman | 428/92 |
| 7,144,173 | B2 | 12/2006 | Policicchio et al. | |
| 7,163,349 | B2 * | 1/2007 | Policicchio et al. | 401/137 |
| 7,294,387 | B2 * | 11/2007 | Wildeman | 428/99 |
| 7,300,691 | B2 | 11/2007 | Callaway | |
| 7,490,569 | B2 * | 2/2009 | Whitten et al. | 112/475.01 |
| 8,060,973 | B2 * | 11/2011 | Wildeman et al. | 15/209.1 |
| 8,151,402 | B2 * | 4/2012 | Takabayashi et al. | 15/229.3 |
| 8,236,711 | B1 * | 8/2012 | Wang | 442/134 |
| 2002/0164448 | A1 * | 11/2002 | Hutchison | 428/86 |
| 2002/0184723 | A1 | 12/2002 | Bishop | |
| 2003/0121116 | A1 | 7/2003 | Keck et al. | |
| 2003/0126710 | A1 | 7/2003 | Policicchio | |
| 2004/0022992 | A1 * | 2/2004 | Wildeman | 428/92 |
| 2004/0115388 | A1 * | 6/2004 | Wildeman et al. | 428/95 |
| 2004/0253409 | A1 * | 12/2004 | Whitten et al. | 428/89 |
| 2006/0052269 | A1 | 3/2006 | Panandiker et al. | |
| 2006/0084345 | A1 | 4/2006 | Kann | |
| 2007/0101771 | A1 * | 5/2007 | Wildeman et al. | 66/169 R |
| 2007/0135006 | A1 * | 6/2007 | Michaels et al. | 442/69 |
| 2007/0148433 | A1 * | 6/2007 | Mallory et al. | 428/304.4 |
| 2007/0281562 | A1 | 12/2007 | Kohlman | |
| 2008/0280094 | A1 * | 11/2008 | Wildeman et al. | 428/91 |
| 2010/0035014 | A1 * | 2/2010 | Hammons et al. | 428/88 |

* cited by examiner

FIG. –1–

STITCH BONDED MULTI-SURFACE FOAM CLEANING PAD

CROSS-REFERENCE TO RELATED APPLICATIONS

This application claims the benefit of and priority from U.S. Provisional Application 61/170,304 filed Apr. 17, 2009 and U.S. Provisional Application 61/214,586 filed Apr. 23, 2009 the contents of all of which are hereby incorporated by reference herein in their entirety.

TECHNICAL FIELD

The present invention relates generally to cleaning systems for floors and other surfaces, and more particularly, to cleaning systems incorporating a foam body with a plurality of yarn elements stitched through the foam body. The foam body and yarn elements cooperatively provide a cleaning element of variable surface structure that can be used alone or in attached relation to an underlying foam sponge block. Exemplary non-limiting uses may include domestic or industrial cleaning of hard surfaces, floors, bathrooms, kitchens and the like.

BACKGROUND OF THE INVENTION

Fabric formation using so-called stitch bonding techniques is well known. In such processes, a multiplicity of stitching yarns is passed repeatedly in stitching relation through one or more substrate layers in closely spaced rows so as to form a coordinated arrangement of surface stitches in covering relation to the substrate. It is possible to use such stitch bonding techniques to form substantially uniform surfaces covered by the stitching yarns. It is also possible to impart patterns of stitching yarns across the surface by manipulation of the formation process. Such patterns may use upstanding loops, substantially flat stitches or combinations thereof.

It is also known to use a cleaning element having a cleaning layer defining a scrubbing surface for contacting a floor or other surface to be cleaned and a foam backing for absorption and retention of water or other cleaning fluid. Such prior cleaning elements have typically used adhesive bonding or other attachment techniques to secure the cleaning layer to the foam backing.

SUMMARY OF THE INVENTION

The present invention provides advantages and/or alternatives over the prior art by providing a foam core cleaning element of stitch-bonded construction incorporating one or more substrate layers of an absorbent foam and a pattern of outwardly projecting pile elements.

In accordance with one exemplary aspect, a foam core cleaning element of stitch-bonded construction having a multi-surface operative cleaning face is provided. The cleaning element includes at least one fluid absorbing layer of absorptive polymeric foam. At least a first plurality of yarns extends in discontinuous patterned stitched relation through discrete selected zones of the fluid absorbing layer such that the first plurality of yarns forms a patterned array of first surface loop zones projecting outwardly away from a first side of the fluid absorbing layer in a defined patterned arrangement across the operative cleaning face of the cleaning element. A plurality of stitch-free zones of the polymeric foam define outwardly projecting convex curved surfaces at positions adjacent to the first surface loop zones across the operative cleaning face of the cleaning element.

In accordance with a further exemplary aspect, loop-forming stitching yarns of differing filament count may be used at different zones in the cross-machine direction during formation such that the formed element incorporates discrete zones of surface loops of micro-fiber yarn characterized by a high filament count in combination with discrete zones of surface loops of yarn characterized by a substantially lower filament count. The low filament count yarn may include, without limitation, monofilament yarns or the like to provide scrubbing action. Unstitched zones of exposed foam are present across the surface between zones of yarn stitching. Such a construction provides a cleaning surface with distinct characteristics at different zones.

BRIEF DESCRIPTION OF THE DRAWINGS

The accompanying drawings which are incorporated in and which constitute a part of this specification illustrate exemplary constructions and procedures in accordance with the present invention and, together with the general description of the invention given above and the detailed description set forth below, serve to explain the principles of the invention wherein.

While the invention has been illustrated and will hereinafter be described in connection with certain exemplary embodiments and practices, it is to be understood that in no event is the invention to be limited to such illustrated and described embodiments and practices. On the contrary, it is intended that the present invention shall extend to all alternatives and modifications as may embrace the general principles of this invention within the full and true spirit and scope thereof.

DESCRIPTION OF THE PREFERRED EMBODIMENTS

Figure 1:
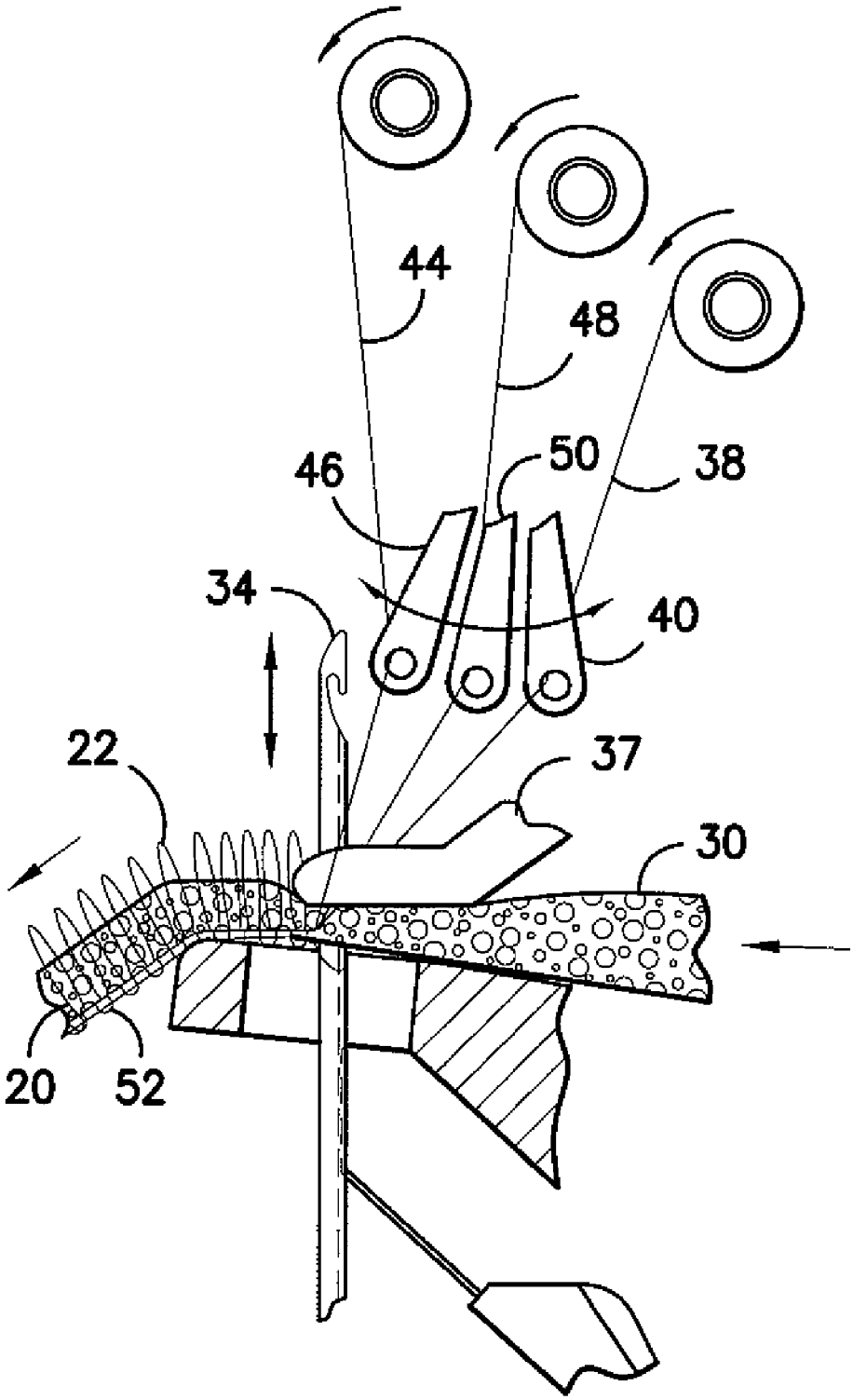
FIG. 1 illustrates schematically a three bar stitch bonding system adapted to form an exemplary foam core cleaning pad structure.

Turning now to the drawings, FIG. 1 illustrates one method utilized to form an exemplary foam core stitch-bonded material 20 including loop elements 22 projecting outwardly from zones of a cleaning surface using a stitch bonding apparatus. In the illustrated practice, a layer of foam substrate material 30 such as a polyurethane foam or the like is conveyed to a stitch-forming position in a stitch-bonding apparatus as will be well known to those of skill in the art. As will be appreciated, in the stitch-bonding apparatus, a pattern of rows of stitches is formed by passing stitching yarns through the substrate material 30 such that the stitching yarns cooperatively form at least a partial covering of stitches across the substrate.

By way of example only, one foam substrate material 30 that may be used is a 3/16 inch thick polyester polyurethane foam sold under the trade designation S82JJ by William T. Burnett & Company having a place of business in Jessup, Md., USA. According to exemplary embodiments, such material may have a density in the range of 20 to 37 kg per cubic meter and more preferably 25 to 32 kg per cubic meter. According to exemplary embodiments, such foam substrate material will preferably have a tensile strength of greater than about 120 kPa and more preferably at least 170 kPa. According to exemplary embodiments, such foam substrate material will preferably have an elongation at break of at least 300% and more preferably at least 450%. According to exemplary embodiments, such foam substrate material will preferably have a tear resistance of greater than about 500 N/m and more preferably about 700 N/m. According to exemplary embodiments, such foam substrate material will preferably have a 25% compression force deflection of at least 2.8 kN/square meter and more preferably about 3.4 KN/square meter or greater and a 50% compression force deflection of at least 2.8 KN/square meter and more preferably about 3.8 KN/square meter or greater. Such foam substrate material will preferably have at least 70% tensile strength retention after 3 hours of steam autoclave at 150 degrees Celsius. In this regard, evaluation of foam properties may be carried out according to ASTM test method D3574 entitled "Standard Methods of Testing Flexible Cellular Materials—Slab, Bonded and Molded Urethane Foam" the contents of which are hereby incorporated by reference in their entirety. Of course foam materials of different character may also be used if desired. Likewise, while only a single layer of foam substrate material 30 is illustrated, it is also contemplated that multiple layers may be used if desired.

The stitch forming position is defined by a row of reciprocating needles 34, extending in adjacent relation to one another across the width of the foam substrate material 30 substantially transverse to the direction of movement of the foam substrate material 30. As will be appreciated, while only a single needle has been illustrated, in actual practice a large number of such needles are arranged in close relation to one another in the cross machine direction between the fingers 37 of a sinker bar. It is contemplated that the so called gauge or needle density in the cross machine direction may be adjusted as desired. By way of example only, and not limitation, it is contemplated that the needle density in the cross-machine zones where the loop elements 22 are formed may be in the range of about 7 to about 28 needles per inch and more preferably about 14 needles per inch although higher and lower needle densities may likewise be used if desired. In these zones, the stitch bonding apparatus may be set to produce a stitch density of about 17 cpi, although higher or lower stitch densities may be used if desired. At the cross-machine locations where no surface loop elements 22 are desired, the needles 34 are preferably removed such that the foam in those zones is not perforated during the manufacturing process. The absence of perforation aids in maintaining the resilient character of the foam substrate material 30 in those locations.

Figure 4A:
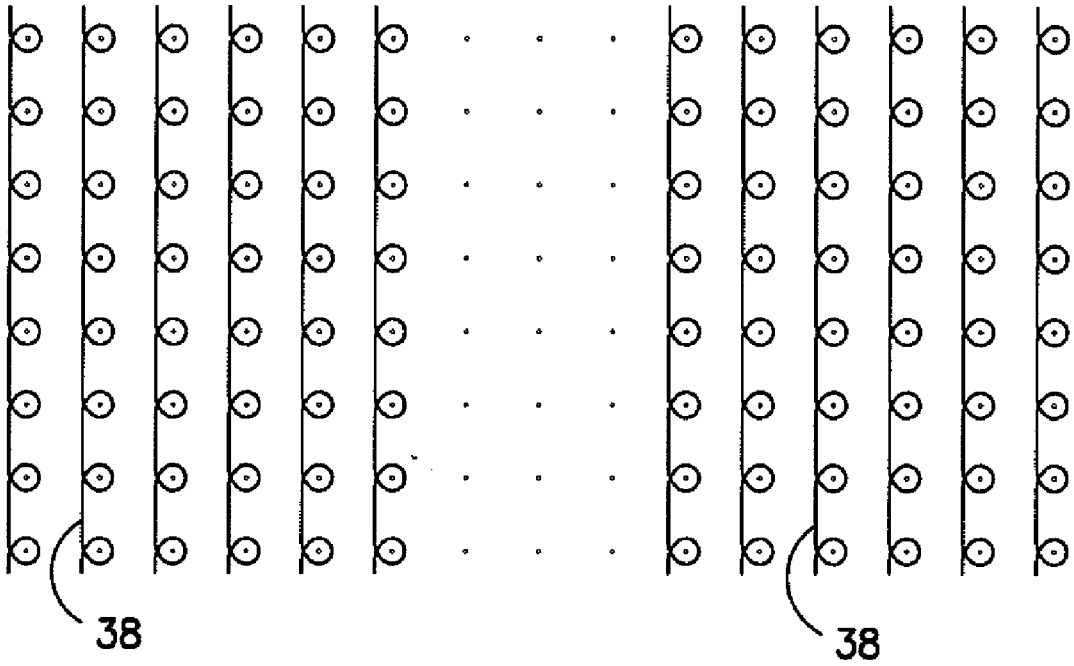
FIGS. 4A and 4B are complementary needle point diagrams illustrating exemplary stitch notations for stitching yarns applied through a foam substrate in a stitch-bonding procedure to yield a pattern of stitched yarns as shown in FIGS. 2 and 3.

According to the illustrated practice, three bars are used to form stitches through the substrate material 30. In the illustrated three bar practice, a multiplicity of ground yarns 38 is threaded through moveable back bar yarn guides 40 carried by the back guide bar (not shown) for engagement with selected needles 34, across the width of the substrate material 30. By way of example only, in one exemplary construction the ground yarns 38 may be threaded in a so called "6 miss 3" pattern (FIG. 4A) such that ground yarns engage 6 needles and then skip 3 needles in a repeating pattern across the machine. However, it is also contemplated that other patterns may be used if desired. As will be described further hereinafter, the pattern of ground yarn stitches acts to lock in the loop elements 22 across the surface of the stitch-bonded material 20.

In the illustrated exemplary construction, the ground yarns 38 are threaded at one end of ground yarn per engaged needle. In practice, the ground yarns 38 are moved into engagement with the selected needles which, in turn, carry the ground yarns in a reciprocating manner through the foam substrate material 30 without engaging finger elements 37 of the sinker bar so as to form an arrangement of flat ground yarn stitches. According to one exemplary practice, the ground yarn stitches are applied in a chain stitch configuration. By way of example only, one suitable construction for the ground yarns 38 is a 63/40/12 draw warped polyester applied in a chain stitch notation of (1-0,1-0). However, other yarn constructions, and other stitching arrangements may likewise be utilized if desired.

According to the illustrated practice, a multiplicity of first pile yarns 44 is carried through moveable front bar yarn guides 46 (only one shown) carried by a front guide bar in a pattern for cooperative engagement with selected needles 34 across the width of the foam substrate material 30. According to the illustrated exemplary practice, a multiplicity of second pile yarns 48 of different character than the first pile yarns 44 may be threaded through middle yarn guides 50 (only one shown) which are carried by the middle guide bar for cooperative engagement with a different group of the needles 34. Thus, the first pile yarns 44 and the second pile yarns 48 may cooperatively form a patterned repeat across the width of the machine to yield stitch zones of different character based on the character of the yarns in those stitch zones.

Figure 2:
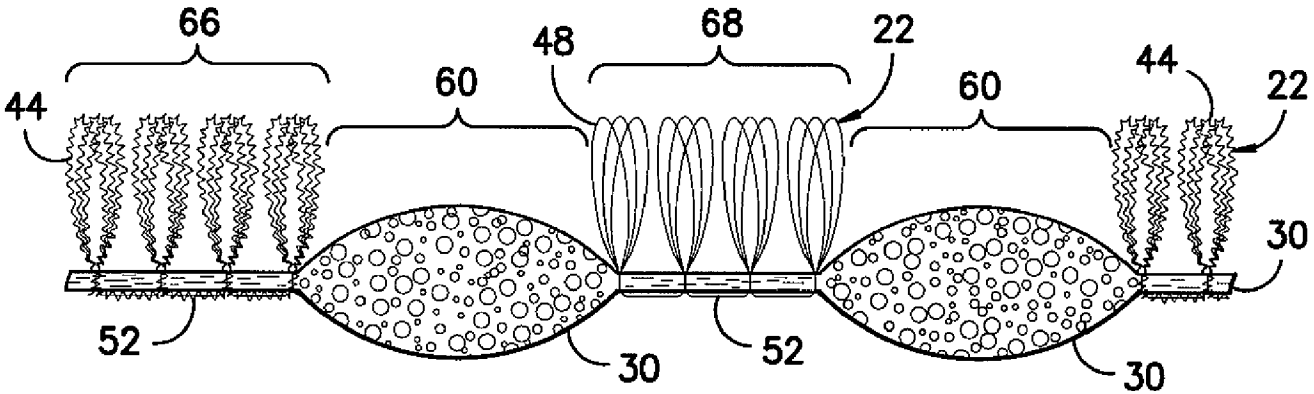
FIG. 2 illustrates schematically a cross-section of a segment of an exemplary foam core cleaning element as viewed in the cross-machine direction incorporating zones of micro-fiber stitching yarns with low dpf levels in combination with monofilament or other stitching yarns with relatively higher dpf levels stitched through a foam substrate to provide stitched zones with upstanding loops in combination with unstitched segments of exposed foam substrate.

In accordance with the exemplary practice, the ground yarns 38 and the pile yarns 44, 48 are each threaded in cooperative patterns so as to leave stitch-free zones 60 across the surface between the zones covered by loop elements 22 (FIG. 2). As best seen through joint reference to FIGS. 4A and 4B, in one exemplary construction the ground yarns 38 may be threaded in a so called "6 miss 3" pattern such that ground yarns engage 6 needles and then skip 3 needle locations in a repeating pattern. The first pile yarns 44 may be threaded in a so called "4 miss 14" pattern such that the first pile yarns 44 follow a repeating pattern of engaging 4 needles and then skipping 14 needle locations. The second pile yarns 48 may be threaded in a so called "skip 9, 4 miss 14" pattern such that the second pile yarns 48 initially skip 9 needle locations, and then follow a repeating pattern of engaging 4 needles and then skipping 14 needle locations. However, it is also contemplated that other patterns may be used if desired.

Figure 4B:
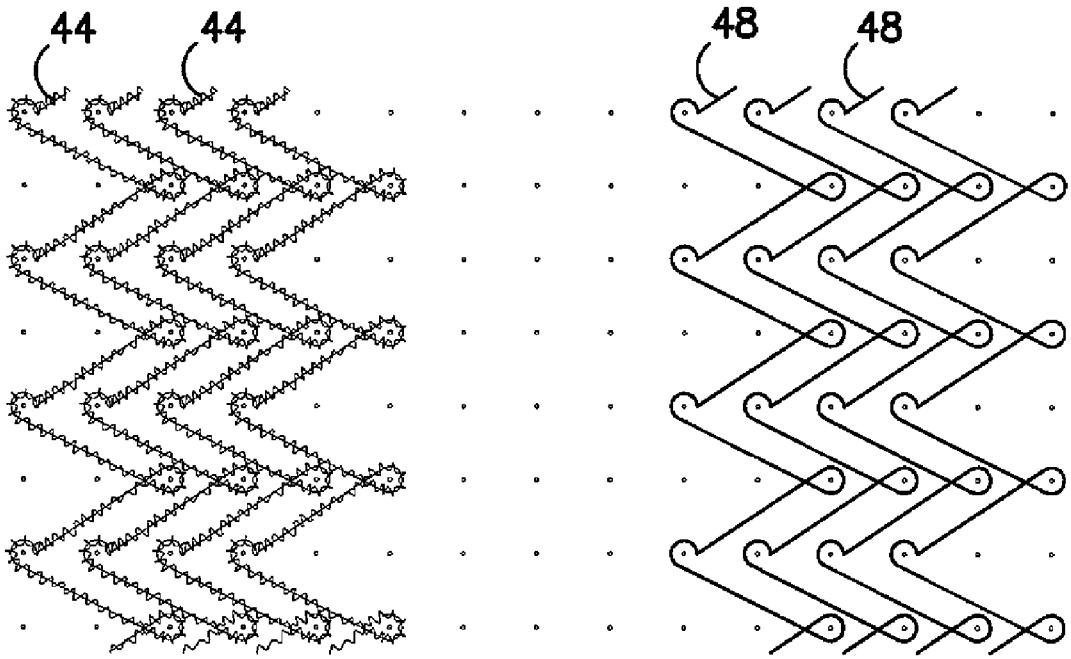

In forming the loop elements 22, the pile yarns 44, 48 are moved back and forth between adjacent needles over intermediate sinker fingers 37. By way of example only, a pile sinker height of about 2-5 millimeters may be desirable. However, other heights may be used if desired. According to one exemplary practice, the first pile yarns 44 and the second pile yarns 48 are each applied in a tricot stitch configuration with a stitch notation of (1-0,3-2) as shown in FIG. 4B. However, other stitching arrangements may likewise be utilized if desired.

In the final construction, the loop elements 22 project outwardly across the so called "technical back" of the stitch-bonded material 20 with flat locking stitches 52 across the so called "technical face". As will be appreciated, the repeating 4 miss 14 pattern of the pile yarns 44, 48 is contained within the boundaries of the 6 miss 3 pattern of the stitches formed by the ground yarns 38. Accordingly, the chain stitch of the ground yarns 38 serves to lock down the loop elements 22.

As previously noted, the complimentary partial threading arrangement of the ground yarns 38 and the pile yarns 44,48 yields stitch-free zones 60 at intermediate positions in the cross-machine direction. As best seen in FIG. 2, these stitch-free zones 60 provide openings across the surface where the underlying foam substrate material 30 is uncovered and may bulge outwardly. In this regard, according to the potentially preferred practice, at the needle locations skipped by the ground yarns 38, the needles are physically removed to avoid perforation of the foam substrate material 30. This absence of perforation aids in maintaining the resilient character of the foam substrate material at the stitch-free zones 60 and enhances the bulging character at those locations.

Following stitching, the resultant stitch-bonded structure may be segmented in the machine and cross-machine directions to yield a cleaning element 62 (FIG. 3) with desired dimensions and having a cross section corresponding to that shown in FIG. 2. In the final construction, the loop elements 22 and convex foam bulges at the stitch-free zones 60 cooperatively define a cleaning face. As will be appreciated, while the cleaning element 62 is shown as generally rectangular, the stitch-bonded structure 20 may be segmented to provide virtually any shape as may be desired.

The use of two or more different pile yarns may be used to form loop elements of different surface character across the width of the formed stitch-bonded material 20 and the resulting cleaning element 62. According to one exemplary embodiment, the first pile yarns 44 carried at the front bar may be so called "micro-fiber yarns" of multi-filament construction. Such micro-fiber yarns are formed from ultrafine fiber of less than 1 denier per filament (dpf). Such yarns are characterized by a soft feel and very high effective surface area. In this regard, such micro-fiber yarns may be made up of at least a predominant percentage of fiber with a dpf level of less than 0.8 and will more preferably be made up of at least a predominant percentage of fiber with a dpf level of less than 0.6 and will most preferably be made up of at least a predominant percentage of fiber with a dpf level of less than 0.4 when evaluated on a weight basis. That is, according to the potentially preferred practice, 51% or more of the fiber weight in the first pile yarns 44 may made up of fibers with these dpf levels. In accordance with one exemplary embodiment, such micro-fiber yarns may be formed substantially entirely from fiber with a dpf level of about 0.4 or less. By way of example only, and not limitation, one micro-fiber yarn construction for use as the first pile yarns 44 is a 1/150/408 (i.e. 150 denier, 408 filament) textured polyester yarn. While polyester may be potentially desirable for the micro-fiber yarns, other natural or synthetic materials including nylon, polypropylene, cotton or blends of any identified materials also may be used if desired.

According to one exemplary embodiment, the second pile yarns 48 are monofilament yarns or multi-filament yarns incorporating at least a predominant percentage of fiber with a dpf level of greater than about 2. Such yarns will be substantially stiffer and more abrasive than the low dpf micro-fiber yarns. The second pile yarns 48 will preferably be made up of at least a predominant percentage of fiber with a dpf level of greater than 3 and will most preferably be made up of at least a predominant percentage of fiber with a dpf level of greater than 4 when evaluated on a weight basis. That is, according to the potentially preferred practice, 51% or more of the fiber weight in the second pile yarns 48 may be made up of fibers with these dpf levels. In accordance with one exemplary embodiment, the second pile yarns may be formed substantially entirely from fiber with a dpf level of greater than 4. By way of example only, and not limitation, one yarn for use as the second pile yarn 48 is a monofilament yarn with a linear density of about 200 to 800 denier. One such yarn is a 300/1 PE (i.e. 300 denier monofilament). However, multi-filament yarns may also be used if desired.

According to a potentially desirable practice, the second pile yarns 48 are made up predominantly (on a weight percentage basis) from fibers characterized by a dpf level which is at least 5 times greater than the dpf level of the ultrafine fibers in the first pile yarns 44. More preferably, the second pile yarns 48 are made up predominantly (on a weight percentage basis) from fibers characterized by a dpf level which is at least 10 times greater than the dpf level of the ultrafine fibers in the first pile yarns. Most preferably, the second pile yarns 48 are made up predominantly (on a weight percentage basis) from fibers characterized by a dpf level which is at least 100 times greater than the dpf level of the ultrafine fibers in the first pile yarns. As described below, the use of first pile yarns 44 and second pile yarns 48 with substantially different dpf levels results in loop zones of different abrasive character across the surface of the final cleaning element 62.

Figure 3:
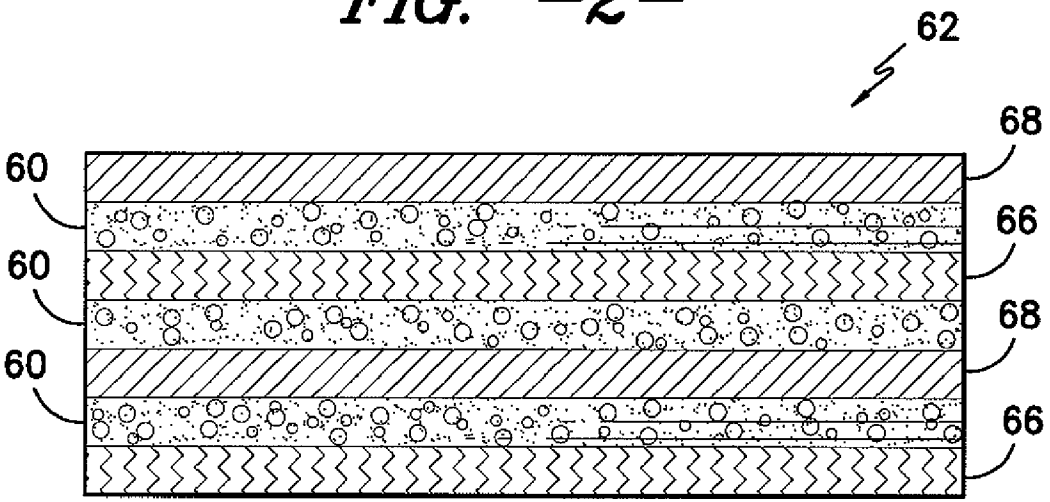
FIG. 3 is a schematic elevation plan view of the exemplary foam core cleaning element structure of FIG. 2.

As will be recognized by those of skill in the art, the threading pattern of first pile yarns 44 and the second pile yarns 48 provides a first set of rows 66 of loop elements formed by the high filament count micro-fiber first pile yarns 44 and a second set of rows 68 of loop elements formed by the coarse dpf second pile yarns 48. The first set of rows 66 is separated from the second set of rows 68 by rows of exposed foam defined by the stitch-free zones 60. This exemplary striped patterned arrangement is best illustrated in FIGS. 2 and 3.

As will be appreciated, the first set of rows 66 of loops formed by the high filament count micro-fiber first pile yarns 44 are relatively soft and are characterized by a very high surface area. During a cleaning operation, such character is believed to be beneficial in attracting and retaining particulate matter. Thus, the first set of rows 66 define particle retention zones across the cleaning surface of the cleaning element 62. Conversely, the second set of rows 68 of loops formed by the coarse second pile yarns 48 have a more abrasive character with lower surface area. During a cleaning operation, such character is believed to be beneficial in loosening matter from a surface to be cleaned by scrubbing action. Thus, the second set of rows 68 define scrubbing zones across the cleaning surface of the cleaning pad cleaning element 62.

While the use of micro-fiber yarns in combination with mono-filament and/or standard filament yarns may be desirable in many environments of use, it is also contemplated that the first pile yarns 44 and second pile yarns 48 may each be formed predominantly from fibers with dpf levels greater than 1. That is, no micro-fiber yarns are used. In such a construction, patterning providing relatively softer and coarser zones may still be achieved by use of yarns with different dpf levels in various zones even if those dpf levels are all greater than one. Likewise, it is also contemplated that first stitching yarns 44 and second stitching yarns 45 may each be formed from predominantly from fibers with dpf levels less than 1. That is, only, micro-fiber yarns are used. In such a construction, patterning providing relatively softer and coarser zones may still be achieved by use of yarns with different dpf levels in various zones even if those dpf levels are all less than one.

While the use of a two loop yarn system is illustrated, it is also contemplated that three or more loop yarns of different character may be used at different zones in the cross-machine direction to provide desired performance characteristics. By way of example only, and not limitation, it is contemplated that a third yarn (not shown) such as an intermediate stiffness multi-filament or the like may be threaded to needles at selected zones to provide further pattern diversity. Likewise, yarns of other character may be placed as desired. Moreover, while striped patterns may be desirable, it is also contemplated that other pattern arrangements may be used with zones of micro-fiber yarn loops and coarse filament yarn loops at different locations if desired. By way of example only, and not limitation exemplary techniques for forming various patterns in a stitch-bonded product are described in U.S. Pat. No. 6,855,392, the contents of which are incorporated by reference herein in their entirety. In this regard, it is contemplated that in applying such techniques to the present invention, yarns with different dpf levels may be applied in different loop zones to provide a desired pattern of coarse and soft loop zones across the surface of the cleaning element 62.

It is also contemplated that a single yarn system may be used if desired such that only yarns of either micro-fiber construction or coarse dpf construction are used. By way of example, in such a construction, a common yarn type may be used in all loops interposed by stitch-free zones to define a striped pattern. Alternatively, two or more different microfiber yarns may be used to provide a patterning effect with zones of different character.

In addition to the cleaning benefits, the use of multi-filament stitch zones in combination with stitch-free zones of exposed foam also may aid in securing a resultant cleaning element 62 to an adjacent structure such as an absorptive structure. Specifically, the high surface area of the yarns aids in the ability of the relatively flat locking stitches formed by yarn segments across the side of the pad facing away from the loop elements to attach to adjacent structures. Thus, the cleaning element 62 may be used as formed or can be adjoined to another underlying surface. By way of example only, and not limitation, the surface of the cleaning element 62 facing away from the loop elements may be attached to a layer or block of foam or other material. This attachment may be by any suitable technique including adhesive bonding, flame lamination or the like as may be desired.

Figure 5:
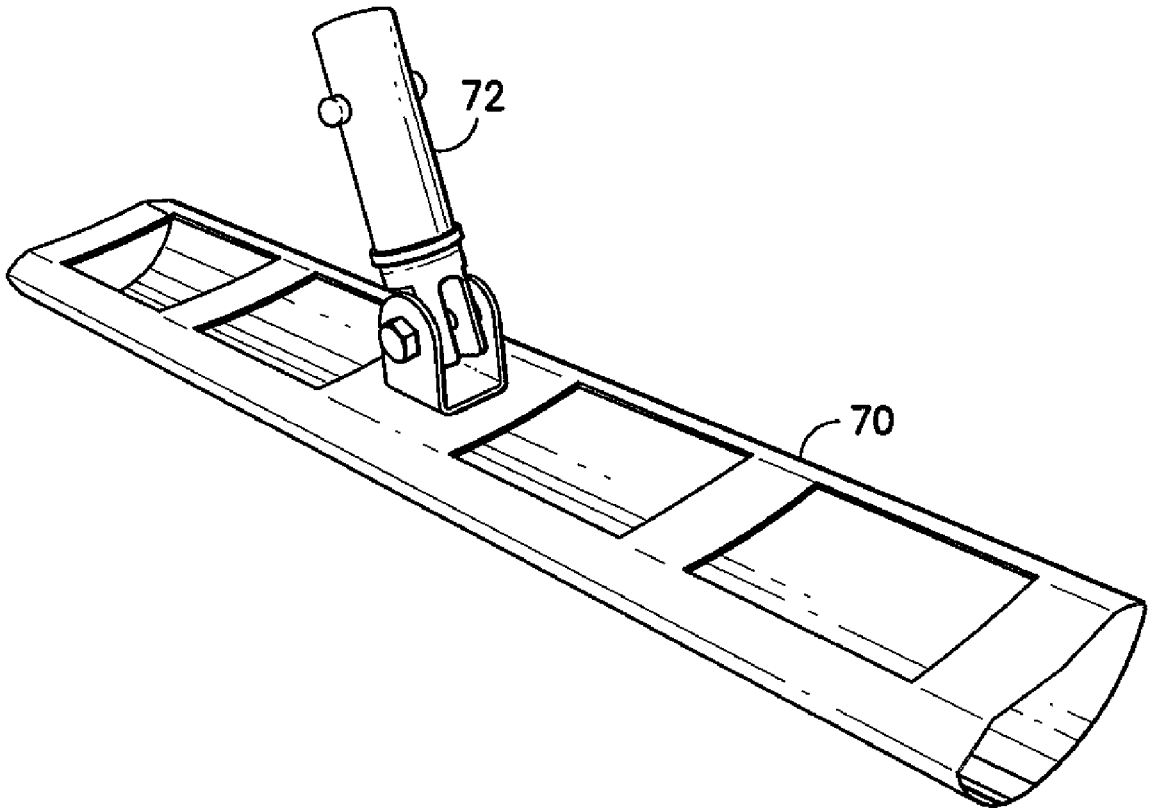
FIG. 5 illustrates an exemplary mandrel for a curved surface mop.
Figure 6:
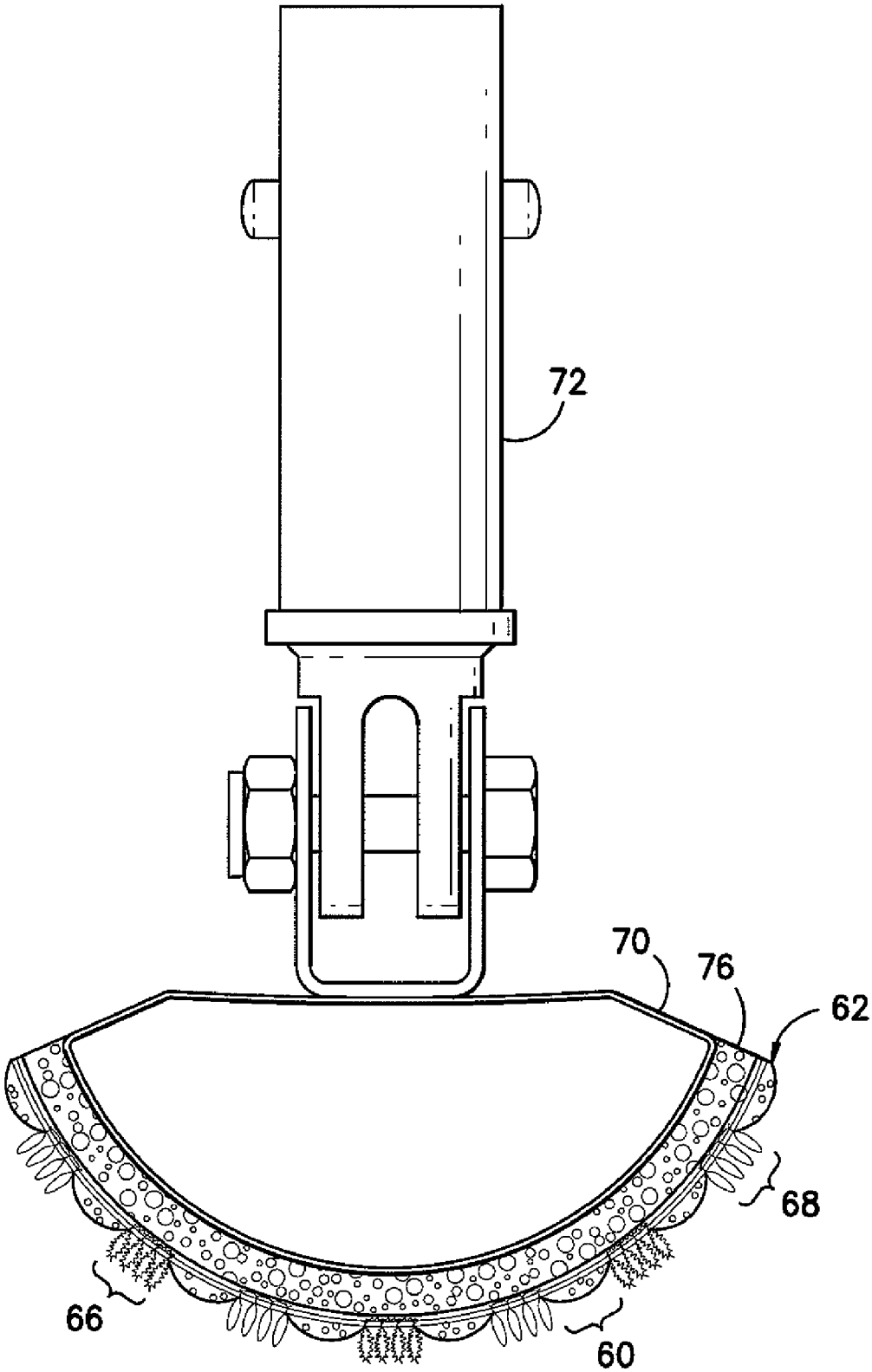
FIG. 6 illustrates a foam core cleaning element structure of FIG. 2 in attached relation to a foam backing layer disposed across the surface of the mandrel of FIG. 5.

In accordance with one contemplated use, the cleaning element 62 may be secured across a flat or curved mop head to define a cleaning surface. In this regard, FIG. 5 illustrates an exemplary curved mop head mandrel 70 which is operatively connected to a handle 72. The mandrel 70 may be formed from metal, plastic or other suitable material. As shown in FIG. 6, an exemplary cleaning element 62 incorporating spaced rows 66, 68 of loop elements of different character and convex zones 60 of stitch-free foam maybe disposed across a lower surface of the mandrel 70. In the illustrated exemplary arrangement, an intermediate layer 76 of foam or other material is adjoined to the cleaning element 62 to provide additional absorptive capacity. However, such an intermediate layer is not essential. Attachment to the mandrel may be by adhesives or any other suitable technique as may be desired.

As will be appreciated, with the cleaning element 62 in place, the alternating stripes of different character are arranged along the length dimension of the mandrel generally transverse to the direction of movement during a cleaning operation. Thus, the cleaning element 62 presents a pattern of zones of different character to the floor or other surface to be cleaned thereby promoting an efficient and thorough cleaning operation.

Of course, variations and modifications of the foregoing are within the scope of the present invention. Thus, it is to be understood that the invention disclosed and defined herein extends to all alternative combinations of two or more of the individual features mentioned or evident from the text and/or drawings. All of these different combinations constitute various alternative aspects of the invention. The embodiment described herein explain the best modes for practicing the invention and will enable others skilled in the art to utilize the invention. The claims are to be construed to include alternative embodiments and equivalents to the extent permitted by the prior art.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Various features of the invention are set forth in the following claims.

What is claimed is:

1. A cleaning element of stitch-bonded construction having a multi-surface operative cleaning face, the cleaning element comprising:

at least one fluid absorbing layer comprising absorptive polymeric foam;

at least a first plurality of yarns extending in discontinuous patterned stitched relation through discrete selected zones of the fluid absorbing layer such that the first plurality of yarns forms a patterned array of first surface loop zones projecting outwardly away from a first side of the fluid absorbing layer in a defined patterned arrangement across the operative cleaning face of the cleaning element; and a plurality of stitch-free zones of the polymeric foam, the stitch-free zones defining outwardly projecting convex curved surfaces of the polymeric foam disposed at positions adjacent to the first surface loop zones across the operative cleaning face of the cleaning element.

2. The cleaning element as recited in claim 1, wherein the first plurality of yarns are textured polyester yarns made up predominantly of microdenier filaments having a linear density of less than 0.8 denier per filament.

3. The cleaning element as recited in claim 1, wherein the first plurality of yarns are textured polyester yarns made up predominantly of microdenier filaments having a linear density of less than 0.6 denier per filament.

4. The cleaning element as recited in claim 1, wherein the first plurality of yarns are textured polyester yarns made up predominantly of microdenier filaments having a linear density of less than 0.4 denier per filament.

5. The cleaning element as recited in claim 1, wherein the absorptive polymeric foam is a polyurethane foam.

6. The cleaning element as recited in claim 5, wherein the absorptive polymeric foam is not perforated within the stitch-free zones.

7. The cleaning element as recited in claim 1, wherein the first plurality of yarns are characterized by a linear density in the range of 60 denier to 400 denier.

8. A cleaning system comprising a cleaning element as recited in claim 1 in combination with a mop head operatively connected to a handle.

9. A cleaning element of stitch-bonded construction having a multi-surface operative cleaning face, the cleaning element comprising:

at least one fluid absorbing layer comprising absorptive polymeric foam;

at least a first plurality of pile yarns of multifilament construction extending in discontinuous patterned stitched relation through discrete selected zones of the fluid absorbing layer such that the first plurality of pile yarns forms a patterned array of first surface loop zones projecting outwardly away from a first side of the fluid absorbing layer in a defined patterned arrangement across the operative cleaning face of the cleaning element, the first plurality of pile yarns being made up predominantly of microdenier filaments having a linear density of less than 1 denier per filament;

at least a second plurality of pile yarns extending in discontinuous patterned stitched relation through discrete selected zones of the fluid absorbing layer such that the second plurality of pile yarns forms a patterned array of second surface loop zones projecting outwardly away from the first side of the fluid absorbing layer in a defined patterned arrangement across the operative cleaning face of the cleaning element, the second plurality of yarns being made up predominantly of filaments having a linear density at least 10 times greater than the microdenier filaments in the first plurality of yarns;

a plurality of ground yarns extending in discontinuous patterned stitched relation through discrete selected zones of the fluid absorbing layer to lock the first plurality of pile yarns and the second plurality of pile yarns in place; and a plurality of stitch-free zones of the polymeric foam, the stitch-free zones defining outwardly projecting convex curved surfaces of the polymeric foam disposed at positions between the first surface loop zones and the second surface loop zones across the operative cleaning face of the cleaning element.

10. The cleaning element as recited in claim 9, wherein the second plurality of yarns are monofilament yarns having a linear density in the range of 200 to 600 denier.

11. The cleaning element as recited in claim 10, wherein the first plurality of yarns are textured polyester yarns made up predominantly of microdenier filaments having a linear density of less than 0.8 denier per filament.

12. The cleaning element as recited in claim 10, wherein the first plurality of yarns are textured polyester yarns made up predominantly of microdenier filaments having a linear density of less than 0.6 denier per filament.

13. The cleaning element as recited in claim 10, wherein the first plurality of yarns are textured polyester yarns made up predominantly of microdenier filaments having a linear density of less than 0.4 denier per filament.

14. The cleaning element as recited in claim 13, wherein the absorptive polymeric foam is a polyurethane foam.

15. The cleaning element as recited in claim 9, wherein the first surface loop zones, the second surface loop zones and the stitch-free zones are arranged in a striped pattern across the operative cleaning face with the stitch-free zones disposed between the first surface loop zones and the second surface loop zones.

16. The cleaning element as recited in claim 15, wherein the first plurality of yarns are characterized by a linear density in the range of 60 denier to 400 denier and the second plurality of yarns are characterized by a linear density in the range of 200 denier to 800 denier.

17. The cleaning element as recited in claim 16, further comprising a foam backing layer.

18. A cleaning system comprising a cleaning element as recited in claim 17 in combination with a mop head operatively connected to a handle.

19. A cleaning element of stitch-bonded construction having a multi-surface operative cleaning face, the cleaning element comprising:

at least one fluid absorbing layer comprising absorptive polymeric foam;

at least a first plurality of pile yarns of multifilament polyester construction extending in discontinuous patterned stitched relation through discrete selected zones of the fluid absorbing layer such that the first plurality of pile yarns forms a patterned array of first surface loop zones projecting outwardly away from a first side of the fluid absorbing layer in a defined patterned arrangement across the operative cleaning face of the cleaning element, the first plurality of pile yarns being made up predominantly of microdenier filaments having a linear density of less than 1 denier per filament;

at least a second plurality of pile yarns extending in discontinuous patterned stitched relation through discrete selected zones of the fluid absorbing layer such that the second plurality of pile yarns forms a patterned array of second surface loop zones projecting outwardly away from the first side of the fluid absorbing layer in a defined patterned arrangement across the operative cleaning face of the cleaning element, the second plurality of yarns being monofilament yarns having a linear density in the range of 200 to 800 denier;

a plurality of multi-filament ground yarns extending in discontinuous patterned stitched relation through discrete selected zones of the fluid absorbing layer to lock the first plurality of pile yarns and the second plurality of pile yarns in place; and a plurality of stitch-free zones of the polymeric foam, the stitch-free zones defining outwardly projecting convex curved surfaces of the polymeric foam disposed at positions between the first surface loop zones and the second surface loop zones across the operative cleaning face of the cleaning element, wherein the first surface loop zones, the second surface loop zones and the stitch-free zones are arranged in a striped pattern across the operative cleaning face with the stitch-free zones disposed between the first surface loop zones and the second surface loop zones.

* * * * *